US008228197B2

(12) United States Patent
Murray

(10) Patent No.: US 8,228,197 B2
(45) Date of Patent: Jul. 24, 2012

(54) FLEXIBLE POUCH WITH SMART TAGS

(75) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 344 days.

(21) Appl. No.: 12/558,699

(22) Filed: Sep. 14, 2009

(65) Prior Publication Data

US 2010/0117819 A1 May 13, 2010

Related U.S. Application Data

(60) Provisional application No. 61/112,820, filed on Nov. 10, 2008.

(51) Int. Cl.
*G08B 13/14* (2006.01)

(52) U.S. Cl. ..... 340/572.1

(58) Field of Classification Search ..... 340/517, 340/10.1, 572.1–572.9
See application file for complete search history.

(56) References Cited

U.S. PATENT DOCUMENTS 4,717,046 A 1/1988 Brogli
6,719,015 B2 4/2004 Murray
7,760,084 B2 * 7/2010 Jensen et al. ..... 340/539.26
7,791,479 B2 * 9/2010 Dearing et al. ..... 340/572.1
7,978,080 B2 * 7/2011 Bleckmann et al. ..... 340/572.8
2004/0107676 A1 6/2004 Murray
2005/0040952 A1 * 2/2005 Dearing et al. ..... 340/572.2
2005/0082195 A1 4/2005 Murray
2006/0062497 A1 3/2006 Murray
2006/0127549 A1 6/2006 Murray
2007/0040653 A1 * 2/2007 Potts et al. ..... 340/10.1
2007/0069898 A1 * 3/2007 White ..... 340/572.6
2007/0113044 A1 5/2007 Day et al.
2007/0189644 A1 8/2007 Murray
2007/0194099 A1 * 8/2007 Miller et al. ..... 235/375
2007/0211967 A1 9/2007 Murray
2008/0095644 A1 4/2008 Mantei et al.

* cited by examiner

*Primary Examiner* — Phung Nguyen
(74) *Attorney, Agent, or Firm* — Gifford, Krass, Sprinkle, Anderson & Citkowski, P.C.

(57) ABSTRACT

The present invention discloses a smart pouch that has a flexible pouch with a plurality of smart tags attached thereto. The plurality of smart tags can include one or more of the following: a radio frequency identification (RFID) tag, a chipless RFID tag, a time sensitive tag, a time-temperature sensitive tag, a package-has-been-opened tag, a cooking instructions tag, and the like. A signal provided by the plurality of smart tags to a reader can provide a plurality of information to the reader and the information can be related to the flexible pouch and any content, product, etc., that may be contained therewithin. In addition, at least one of the plurality of smart tags can be located within an air pocket.

15 Claims, 3 Drawing Sheets

FLEXIBLE POUCH WITH SMART TAGS

CROSS-REFERENCE TO RELATED APPLICATION

This application claims priority of U.S. Provisional Patent Application Ser. No. 61/112,820 filed Nov. 10, 2008, entitled "Flexible Pouch with Smart Tags", which is incorporated herein in its entirety by reference.

FIELD OF THE INVENTION

The present invention relates to a flexible pouch, and in particular to a smart pouch with a plurality of smart tags attached to the flexible pouch that can provide a plurality of information to a reader.

BACKGROUND OF THE INVENTION

Flexible pouches used to contain food products, cleaning products, etc., are known. Such types of flexible pouches can have a barcode thereon that affords for scanning of the pouch in order to determine its price. In addition, some flexible pouches are known to have a radio frequency identification (RFID) tag or label that can be remotely scanned by a reader, the RFID tag operable to provide information about the pouch to the reader and, for example, an inventory control system. However, heretofore flexible pouches with RFID tags have seen limited use due to the cost of the tag and the limited amount of information that can be contained and/or provided by a single tag. Therefore, a flexible pouch that has a plurality of tags that can be remotely read by a reader and provide information about the pouch and/or a product contained therein would be desirable.

SUMMARY OF THE INVENTION

The present invention discloses a smart pouch that has a flexible pouch with a plurality of smart tags attached thereto. The plurality of smart tags can include one or more of the following: a radio frequency identification (RFID) tag, a chipless RFID tag, a time sensitive tag, a time-temperature sensitive tag, a package-has-been-opened tag, a cooking instructions tag, and the like. A signal provided by the plurality of smart tags to a reader can provide a plurality of information to the reader and the information can be related to the flexible pouch and any content, product, etc., that may be contained therewithin. In addition, at least one of the plurality of smart tags can be located within an air pocket.

The information provided by the plurality of smart tags can be related to: identification of a product sealed within the flexible pouch, a date the flexible pouch was manufactured, a date a product was sealed within the flexible pouch, an expiration date of the flexible pouch, an expiration date of a product sealed within the flexible pouch, a cooking instruction for a product sealed within the flexible pouch, a package-has-been-opened signal, and the like. The smart pouch can further include a product that is sealed therewithin.

In some instances, a machine with a reader that is operative to read a signal from the plurality of smart tags and process the pouch and/or its content can be included. For example, the machine can be a microwave oven with a reader that is operative to cook a product within the pouch per cooking instructions provided by a smart tag this is read by the reader.

If one of the smart tags is a time-temperature sensitive tag, a signal can be provided to the reader when the product that is, or has been, sealed in the pouch has been at a predetermined temperature for a predetermined amount of time. For example, the time-temperature sensitive tag can be operative to change color when the product has been at the predetermined temperature for the predetermined amount of time and the reader can be operative to detect a color change of the tag.

DETAILED DESCRIPTION OF THE INVENTION

Figure 1:
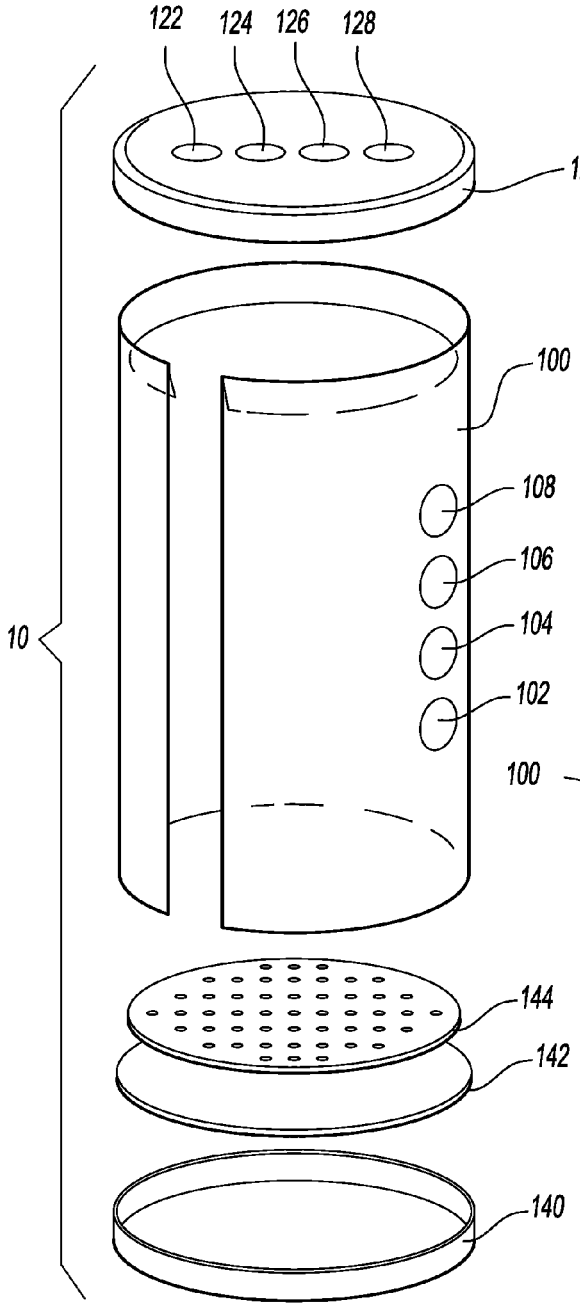
FIG. 1 is an exploded view of an embodiment of the present invention.

A flexible pouch with a plurality of smart tags is provided. As such, the present invention has utility as a container for a product.

For the purposes of the present disclosure, the term "smart tag" is defined as a tag that can be remotely scanned by a reader and provide information about the pouch and/or a product contained within the pouch. In addition, a "reader" can be an electronic device that sends a signal to a tag and in response receives a signal from the tag. The term "reader" can also include an individual looking at a tag and receiving information therefrom. For example, a reader in the form of an individual can look at a tag that changes color with time, and based on the color of the tag determine information, status, etc., about a flexible pouch that has the tag attached thereto. It is appreciated that a reader can also be in the form of a color-detecting scanner that can be used to scan a color-changing tag and determine its color at a given time.

The plurality of smart tags can include two or more tags such as a radio frequency identification (RFID) tag, a chipless RFID tag, a time sensitive tag, a time-temperature sensitive tag, a package-has-been-opened tag, a cooking instruction tag and the like. The plurality of smart tags are attached to the flexible pouch and can be attached during a manufacturing process of the pouch and/or after the pouch has been manufactured.

In some instances, the RFID tag has an antenna and a chip with an integrated circuit. The antenna can be printed on a first piece of tape and the chip attached to a second piece of tape. The first piece of tape can be aligned with and attached to the second piece of tape, such that the antenna is in electronic communication with the chip and thereby affords for an RFID tag. In the alternative, the antenna and the chip can be printed and/or attached to a single piece of tape. The RFID tag can be absent an internal power supply and yet be operable using a minute electrical current induced in the antenna by an incoming radio frequency signal that provides just enough power for the integrated circuit of the chip to power up and transmit a response.

The chipless RFID tag is an RFID tag that does not contain a chip. The tag uses fibers or materials that reflect a portion of a signal transmitted by a reader back to the reader. The return signal can be unique and used as an identifier and/or to provide data to the reader. The chipless RFID tag can be in the form of a surface acoustic wave tag, printed stripes of conductive ink, a thin film transistor circuit tag and the like. In addition, the RFID tag and/or the chipless RFID tag can be located within an air pocket, for example an air pocket located within a side seal, bottom seal or some other sealed portion of the flexible pouch.

The time sensitive tag and the time-temperature sensitive tag can be in the form of a time sensitive ink and/or a time-temperature sensitive ink. For example and for illustrative purposes only, OnVu™ time-temperature indicators can record accumulated effects of time and/or temperature for a given package that the indicator is attached to by changing color as a function of time and/or temperature.

A package-has-been-opened tag, as the name implies, can indicate to a reader that a package that the tag is attached to has been opened. For example and for illustrative purposes only, an antenna that is attached to a flexible pouch can have a first length before the pouch has been opened and a second length after the pouch has been opened. The two lengths of the antenna can each provide a unique signal to a reader and thereby provide information as to whether or not the pouch has been opened.

A tag that contains cooking instructions for a product within a flexible pouch can be in the form of an RFID tag, a chipless RFID tag and the like. The cooking instructions tag can be read by a reader and thereby provide cooking instructions to an automated cooking system. For example and for illustrative purposes only, a flexible pouch having a cooking instructions tag could be placed within a microwave oven having a reader. Thereafter the reader can read cooking instructions from the tag and afford for the microwave to cook the product within the flexible pouch according to the cooking instructions. It is appreciated that the reader can be in electronic communication with a control circuit that controls a cavity magnetron of the microwave oven. In this manner, safe cooking instructions and operation can be provided and prevent undercooked food, overcooked food and/or accidents within a cooking device.

It is further appreciated that a cooking device can have a reader operative to read a time-temperature sensitive tag that provides a signal related to when a product that is sealed, or has been sealed, within the smart pouch has been at, or above, a predetermined temperature for a predetermined amount of time. For example, if the time-temperature sensitive tag changes color as a function of time and temperature, then the reader detects the change in color, the change in color being the result of the product being at, or above, a predetermined temperature for a predetermined amount of time. In the alternative, an antenna and/or chip of a smart tag can have one or more properties, e.g. length, transmitting power, etc., that change as a function of time and/or temperature.

Figure 2:
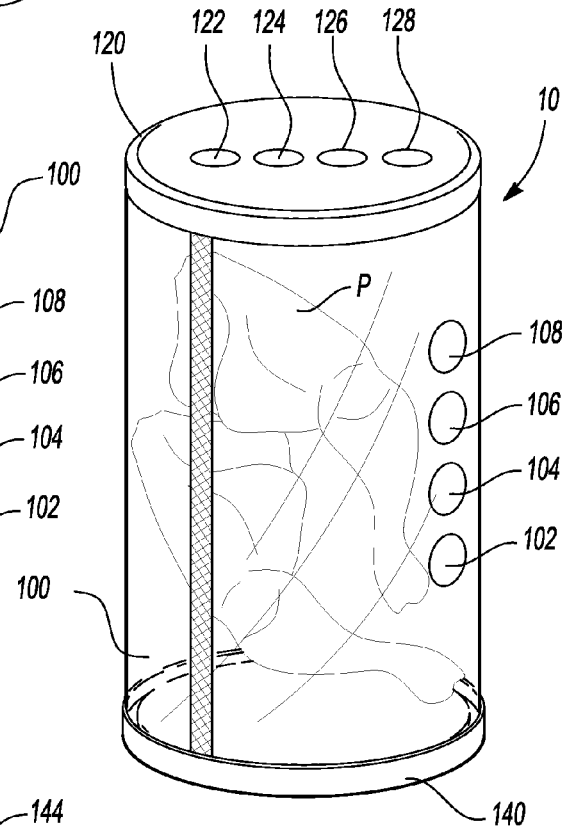
FIG. 2 is a perspective view of the embodiment shown in FIG. 1 with a product sealed within a flexible pouch.

Turning now to FIGS. 1 and 2, a flexible pouch having a plurality of smart tags attached thereto is shown generally at reference numeral 10. The flexible pouch 10 can include a panel 100 in the form of a tube with a first end cap 120 and a second end cap 140. In some instances, the second end cap 140 can have a false bottom that is made from a perforated layer 144 with an insert 142 being placed within the false bottom, that is, the insert 142 is located between the perforated layer 144 and the first end cap 140. The insert 142 can be an absorbent layer, a flavor additive and the like. In this manner, if the insert 142 is an absorbent layer, liquid, moisture and/or oxygen within the flexible pouch 10 can be absorbed.

Also shown on the flexible container 10 is a plurality of smart tags as schematically represented by circles 102, 104, 106 and 108. It is appreciated that the circles 102-108 schematically represent a plurality of smart tags, the smart tags having any shape such as square, rectangle, polygon, etc. The plurality of smart tags 102-108 can be attached to the flexible pouch 10 during the manufacturing process of the pouch 10 and/or after the pouch has been completed. The smart tags 102-108 can be any type of smart tag that provides information to a reader regarding the pouch 10 and/or any product P therewithin. It is appreciated that four circles are shown on the pouch 10 for illustrative purposes only and that the number of smart tags on the flexible pouch 10 can range from any number equal to or greater than 2.

Optionally, one or more of the plurality of smart tags can be attached to one of the end caps for the flexible pouch 10. For example, and for illustrative purposes only, one or more of the smart tags can be attached to the first end cap 120, schematically shown as circles 122, 124, 126 and 128. In addition, one or more of the smart tags can be located within and/or attached to the insert 142. It is appreciated that the location of these circles 102-108 and/or 122-128, which schematically represent smart tags, is for illustrative purposes only and that one or more of the smart tags can be placed anywhere within the pouch 10 and/or on the outside of the pouch 10. In the alternative, one or more of the smart tags can be attached to the flexible pouch 10 using an attachment member such as a piece of thread, wire and the like.

The smart tags can include an RFID tag, a chipless RFID tag, a time sensitive tag, a time-temperature sensitive tag, a package-has-been-opened tag, a cooking instructions tag and the like. The RFID tag can include information such as the contents of the flexible pouch 10, the date the pouch 10 was made, the date the product P was placed within the pouch 10, an expiration date for the pouch 10, an expiration date for the product P within the pouch 10, and the like. A chipless RFID tag can contain the same and/or different information than the RFID tag.

The time sensitive tag and/or the time-temperature sensitive tag can be in the form of an ink label that changes color as a function of time and/or time-temperature that the flexible pouch 10 has been exposed to. The package-has-been-opened tag can be in the form of an antenna 129 as shown in FIG. 2, the antenna having a first length before the package has been opened and a second length after the package has been opened. In this manner, once the package has been opened, for example by removal of the first end cap 120, the antenna 129 can be torn into two pieces and thus a remaining portion of the antenna has a shorter length and can provide a different return signal to a reader than the antenna before it is shortened in length.

Figure 4:
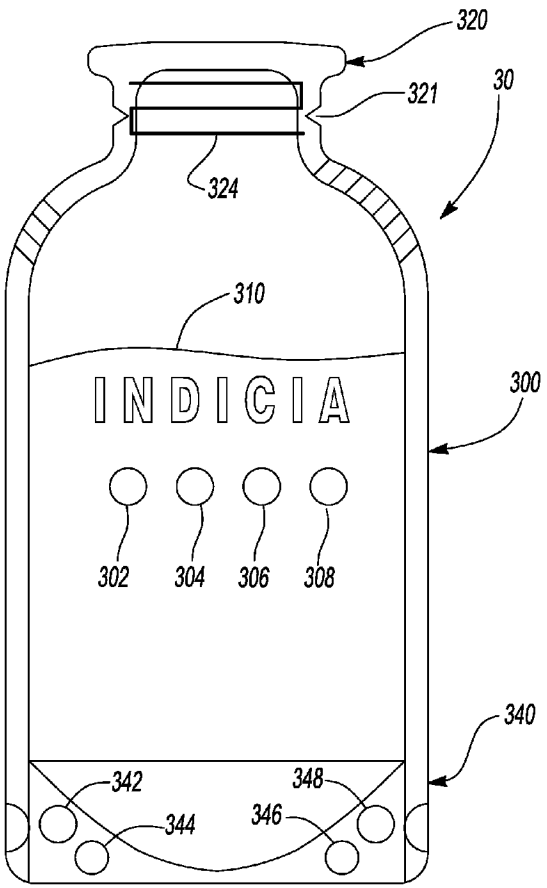
FIG. 4 is a front view of another embodiment of the present invention.
Figure 3:
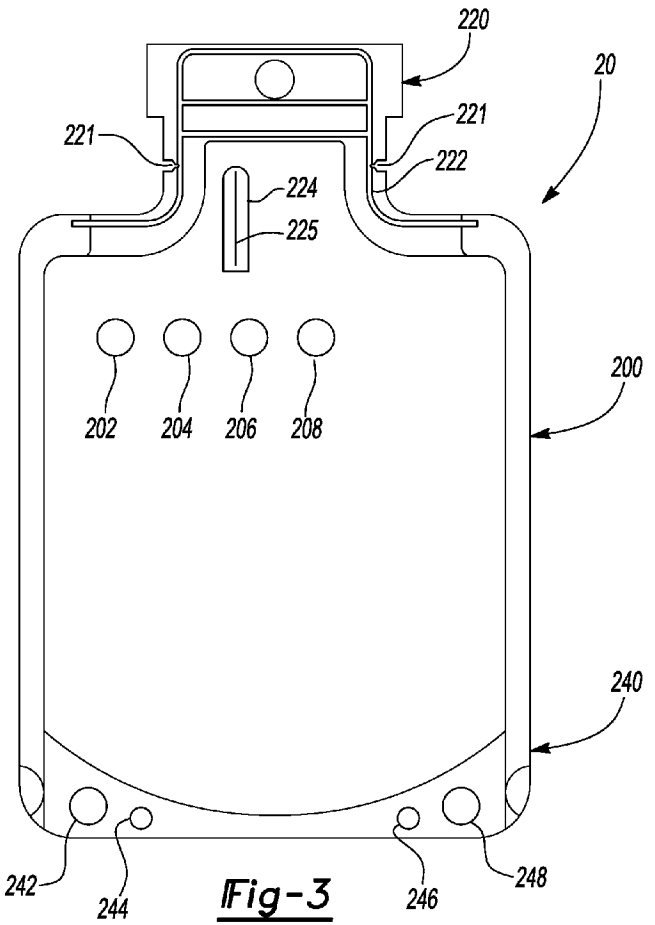
FIG. 3 is a front view of another embodiment of the present invention.

Turning now to FIGS. 3 and 4, in contrast to the flexible pouch 10 shown in FIGS. 1 and 2 where a tube shape is made from a single panel, a flexible pouch 20 and flexible pouch 30 are made from one or more panels that are sealed along side edges in order to form a generally flat flexible pouch before a product is placed therewithin. The flexible pouch 20 can have a main body portion 200, a top portion 220 and a bottom portion 240.

In some instances, a plurality of smart tags, illustratively shown as the circles 202, 204, 206 and 208, can be attached to the main portion 200 and can include the types of smart tags described above. In the alternative, one or more of the plurality of smart tags can be located in the bottom portion 240, for example attached to or within a gusset that is part of the flexible pouch 20. The location of the smart tags in the bottom portion 240 is shown representatively as circles 242, 244, 246 and 248.

The top portion 220 of the flexible pouch 20 can have at least one notch 221 that affords for tearing of the top portion 220 off of the pouch 20 and providing access to a product contained within the main portion 200. A package-has-been-opened tag 224 can be located proximate to the notch 221 such that once the top portion 220 has been removed, e.g. torn off, from the pouch 20, an antenna 225 having a first length when the top portion 220 is still attached to the main portion 200 has a second shorter length after the top portion 220 has been removed. In this manner, the antenna 225 can provide a different return signal to a reader once the package has been opened compared to a return signal provided by the antenna 225 before the package has been opened.

It is appreciated that an antenna 222 can optionally be included within the pouch 20, the antenna 222 providing the same function as the antenna 225 in that once the top portion 220 has been removed from the main portion 200, the antenna 222 has a different length and can thereby provide a package-has-been-opened signal to a reader.

With respect to FIG. 4, a flexible pouch 30 can include a label 310 that has indicia thereon, the label 310 having one or more of the plurality of smart tags, illustratively shown by circles 302, 304, 306 and 308. In the alternative, a bottom portion 340 of the flexible pouch 30 can include one or more of the smart tags as shown by circles 342, 344, 346 and 348. Again, it is appreciated that the smart tags can have any shape and are not restricted by the shape schematically represented by the circles.

The flexible pouch 30 can also have an antenna 324 that will have its length altered when a top portion 320 of the flexible pouch 30 is removed from a main portion 300. In this manner, the antenna 324 can serve as a pouch-has-been-opened tag.

Figure 5:
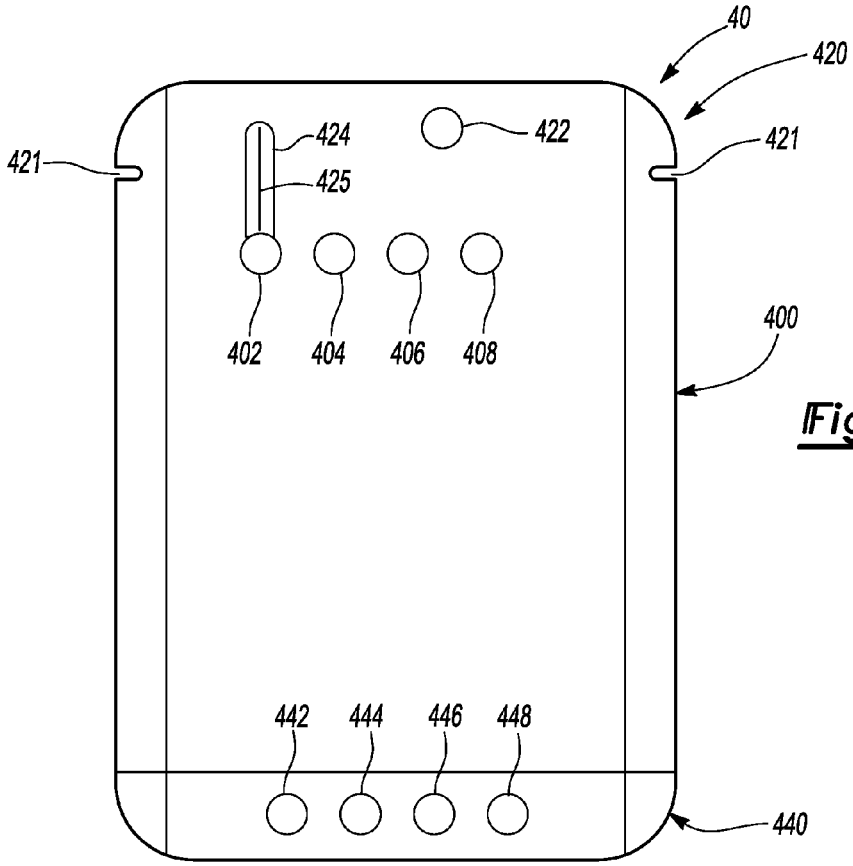
FIG. 5 is a front view of another embodiment of the present invention.

Turning now to FIG. 5, another embodiment of a flexible pouch having a plurality of smart tags is shown generally at reference numeral 40. The flexible pouch 40 has two panels that are sealed along side seams in order to form a main portion 400, a top portion 420 and a bottom portion 440. It is appreciated that similar to FIGS. 3 and 4, a plurality of smart tags can be located in the main portion 400 as illustratively shown by circles 402, 404, 406 and 408. In the alternative, one or more of the smart tags can be located in the bottom portion 440 as illustratively shown by circles 442, 444, 446 and 448.

A package-has-been-opened tag 424 having an antenna 425 that is in communication with the smart tag 402 can be included. In some instances, the smart tag 402 with the antenna 425 can be in the form of an RFID tag. The top portion 420 has at least one notch 421 that affords for opening the flexible pouch 40 by removing the top portion 420. It is appreciated that when the top portion 420 is torn off of the main portion 400, the antenna 425 will be shortened in length and can provide a unique return signal to a reader that is different than a return signal provided by the antenna 425 before its length is shortened. In this manner, a reader can determine whether or not the flexible pouch 40 has been opened. In addition to the plurality of smart tags, it is appreciated that flexible pouches can have other features such as a hanging aperture 422 and the like.

Figure 6:
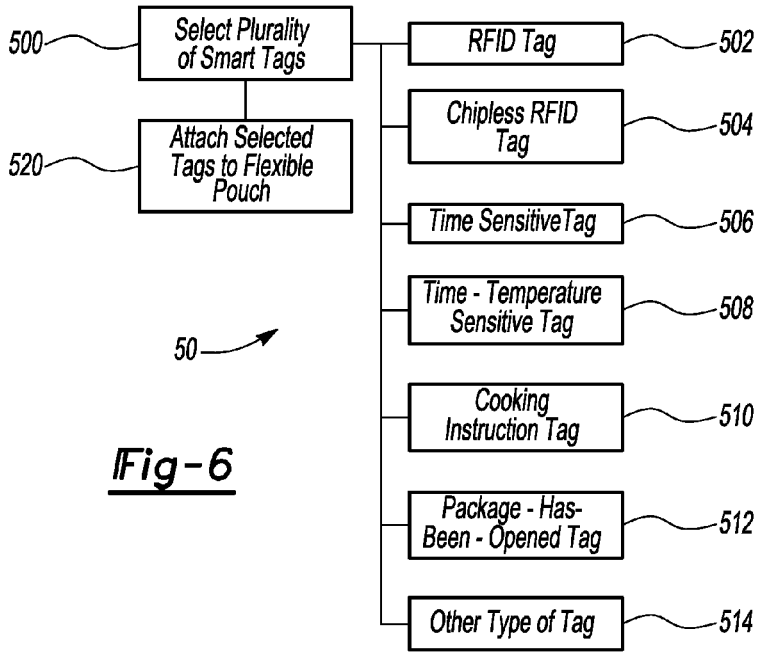
FIG. 6 is a schematic diagram illustrating a process according to an embodiment of the present invention.

Turning now to FIG. 6, a process for making a flexible pouch having a plurality of smart tags is shown generally at reference numeral 50. The process 50 can include selecting a plurality of smart tags at step 500 and attaching the selected tags to a flexible pouch at step 520. The plurality of smart tags can be selected from an RFID tag shown at 502, a chipless RFID tag shown at 504, a time sensitive tag shown at 506, a time-temperature sensitive tag shown at 508, a cooking instruction tag shown at 510, a package-has-been-opened tag shown at 512 and/or another type of tag shown at 514.

It is appreciated that one or more of the selected tags can be attached to the flexible pouch during the manufacturing process of the pouch and/or one or more of the tags can be attached after the pouch-making process has been completed. It is further appreciated that one or more of the selected tags can be attached to a main portion, a top portion, and/or a bottom portion, and combinations thereof. In addition, one or more of the tags can be located within a sealed portion of a flexible pouch, for example within a side seam, end seam and the like. In this manner, a process for producing a flexible pouch that has one or more smart tags that can provide information on the flexible pouch itself and/or on a product contained within the flexible pouch is provided.

The foregoing drawings, discussion and description are illustrative of specific embodiments and examples of the present invention, but they are not meant to be limitations upon the practice thereof. Numerous modifications and variations of the invention will be readily apparent to those of skill in the art in view of the teaching presented herein. As such, the specification should be interpreted broadly.

I claim:

1. A smart pouch comprising:

a flexible pouch; and a plurality of smart tags attached to said flexible pouch;

said plurality of smart tags selected from the group consisting of a radio frequency identification (RFID) tag, a chipless RFID tag, a time sensitive tag, a time-temperature sensitive tag, a package-has-been-opened tag, a cooking instructions tag and combinations thereof;

wherein a signal provided by said plurality of smart tags to a reader provides a plurality of information related to said flexible pouch to said reader;

said plurality of smart tags having information related to and selected from the group consisting of a product sealed within said flexible pouch, a date said flexible pouch was manufactured, a date a product was sealed within said flexible pouch, an expiration date of said flexible pouch, an expiration date of a product sealed within said flexible pouch, a cooking instruction for a product sealed within said flexible pouch, a package-has-been-opened signal and combinations thereof.

2. The smart pouch of claim 1, wherein at least one of said plurality of smart tags is located within an air pocket.

3. The smart pouch of claim 1, further comprising a product sealed within said flexible pouch.

4. The smart pouch of claim 3, wherein said plurality of information is selected from at least two of the group consisting of an identification of said product sealed within said flexible pouch, a date said flexible pouch was manufactured, a date said product was placed within said flexible pouch, an expiration date of said flexible pouch, an expiration date of said product sealed within said flexible pouch, a cooking instruction for said product sealed within said flexible pouch and a package-has-been-opened signal.

5. The smart pouch of claim 4, further comprising a microwave oven with a reader operative to read a signal from said plurality of smart tags;

wherein one of said plurality of smart tags has said cooking instruction for said product; said microwave oven operative to cook said product per said cooking instruction for said product read by said reader.

6. The smart pouch of claim 5, wherein one of said smart tags is a time-temperature sensitive tag operative to signal said reader when said product has been at a predetermined elevated temperature for a predetermined amount of time.

7. The smart pouch of claim 5, wherein one of said smart tags is a time-temperature sensitive tag operative to change color when said product has been at a predetermined elevated temperature for a predetermined amount of time.

8. The smart pouch of claim 1, wherein said plurality of information related to said flexible pouch contains a temperature of said flexible pouch.

9. A smart pouch comprising:

a flexible pouch;

a product sealed within said flexible pouch; and a plurality of smart tags attached to said flexible pouch;

said plurality of smart tags selected from the group consisting of a radio frequency identification (RFID) tag, a chipless RFID tag, a time sensitive tag, a time-temperature sensitive tag, a package-has-been-opened tag, a cooking instructions tag and combinations thereof;

wherein a signal provided by said plurality of smart tags to a reader provides a plurality of information related to said flexible pouch to said reader, said plurality of information selected from at least two of the group consisting of an identification of said product sealed within said flexible pouch, a date said flexible pouch was manufactured, a date said product was placed within said flexible pouch, an expiration date of said flexible pouch, an expiration date of said product sealed within said flexible pouch, a cooking instruction for said product sealed within said flexible pouch and a package-has-been-opened signal.

10. The smart pouch of claim 9, wherein at least one of said plurality of smart tags is located within an air pocket.

11. The smart pouch of claim 9, wherein said plurality of information related to said flexible pouch contains a temperature of said flexible pouch.

12. A smart pouch comprising:

a flexible pouch;

a product sealed within said flexible pouch; and a plurality of smart tags attached to said flexible pouch; and a microwave oven with a reader operative to read a signal from said plurality of smart tags;

wherein one of said plurality of smart tags has a cooking instruction for said product;

said microwave oven operative to cook said product per said cooking instruction for said product read by a reader.

13. The smart pouch of claim 12, wherein said plurality of smart tags is selected from the group consisting of a radio frequency identification (RFID) tag, a chipless RFID tag, a time sensitive tag, a time-temperature sensitive tag, a package-has-been-opened tag, a cooking instructions tag and combinations thereof.

14. The smart pouch of claim 13, wherein a signal provided by said plurality of smart tags to said reader provides a plurality of information related to said flexible pouch to said reader, said plurality of information selected the group consisting of an identification of said product sealed within said flexible pouch, a date said flexible pouch was manufactured, a date said product was placed within said flexible pouch, an expiration date of said flexible pouch, an expiration date of said product sealed within said flexible pouch and a package-has-been-opened signal.

15. The smart pouch of claim 14, wherein said plurality of information is selected from at least two of the group consisting of an identification of said product sealed within said flexible pouch, a date said flexible pouch was manufactured, a date said product was placed within said flexible pouch, an expiration date of said flexible pouch, an expiration date of said product sealed within said flexible pouch and a package-has-been-opened signal.

* * * * *